United States Patent [19]

Verstraeten

[11] Patent Number: 4,623,025

[45] Date of Patent: Nov. 18, 1986

[54] SOIL-DISPLACEMENT DRILL AND METHOD FOR MANUFACTURING A PILE

[75] Inventor: Alexander J. Verstraeten, Knokke-Heist, Belgium

[73] Assignee: Fundex, Zeebrugge, Belgium

[21] Appl. No.: 659,790

[22] Filed: Oct. 11, 1984

[30] Foreign Application Priority Data

Apr. 9, 1984 [NL] Netherlands ..... 8401118

[51] Int. Cl.[4] ..... E02D 5/36; E21B 10/44

[52] U.S. Cl. ..... 175/21; 175/171; 175/388; 175/394; 405/236; 405/242; 405/253

[58] Field of Search ..... 175/19, 20, 21, 22, 175/171, 257, 385, 388, 394; 166/285; 405/236, 242, 253

[56] References Cited

U.S. PATENT DOCUMENTS

| | | | |
|---|---|---|---|
| 4,193,461 | 3/1980 | Lamberton et al. | 175/171 X |
| 4,458,765 | 7/1984 | Feklin et al. | 175/21 X |
| 4,484,640 | 11/1984 | Feklin et al. | 175/21 X |
| 4,496,011 | 1/1985 | Mazo et al. | 175/19 |

FOREIGN PATENT DOCUMENTS

| | | |
|---|---|---|
| 897242 | 11/1983 | Belgium . |
| 0065340 | 11/1982 | European Pat. Off. . |
| 2936060 | 4/1981 | Fed. Rep. of Germany . |
| 2040519 | 1/1971 | France . |
| 2215075 | 8/1974 | France . |
| 7301584 | 12/1973 | Netherlands . |
| 281148 | 12/1927 | United Kingdom . |
| 931427 | 7/1963 | United Kingdom . |

*Primary Examiner*—Stuart S. Levy
*Assistant Examiner*—David Werner
*Attorney, Agent, or Firm*—Stevens, Davis, Miller & Mosher

[57] ABSTRACT

To the drill pipe connects a head comprising a cylinder-shaped portion and a cone-shaped point. Three spiral ribs are regularly distributed over the head. Each rib has a downwardly-extending rib portion standing on the point and having an outer side making an angle between 0° and 5° with the drill axis and an inner side making with the outer side of the point an angle which is smaller than 90° increased by half the apex of the point, and has a outwardly-extending rib portion standing on the cylinder-shaped head portion and having a top side making an angle between 85° and 95° with the outer side of this head portion. The lowermost edge of the rib portion standing on the point merges into the outermost edge of the other rib portion. The apex of the point lies between 85° and 95°.

17 Claims, 7 Drawing Figures

SOIL-DISPLACEMENT DRILL AND METHOD FOR MANUFACTURING A PILE

BACKGROUND OF THE INVENTION

This invention relates to a soil-displacement drill which comprises a drill pipe, a substantially cylinder-shaped portion on the lowermost end thereof and a cone-shaped point connecting to said portion, and at least one spiral rib, which spiral rib comprises a portion lying on the point and having a downwardly-extending outer side, and a portion which connects to the end of said first rib portion, lies on the cylinder-shaped portion and has an outwardly-extending top side.

Such soil-displacement drills are used for the vibration-free making of concrete piles on the ground. Due to the presence of the spiral rib, the displacement drill enters the ground as it is rotated, whereby the soil is pushed away and thus compacted around the drill opening.

The spiral rib is thus no cutting member and the displacement drill is thus not suitable for drilling very hard materials such as rocks. A cutting drill may well do so on the other hand, as it is provided on the point thereof with one or a plurality of cutting members. Said cutting members cut away the soil which is discharged, for example through the drill pipe.

A soil-displacement drill of the above-described type is known from German Utility Model No. G 79 23 274.9 in the name of the Applicant.

The soil-displacement drill according to said Utility Model comprises a single spiral rib. That side facing the point end of the spiral portion lying on the point is directed at right angle to the geometrical axis of the drill. Said point end-facing side does however merge without changing slope and without discontinuity, into the point end-facing side of that spiral rib portion lying on the cylinder-shaped portion.

Moreover, the succeeding windings of the single spiral rib connect sidewise to one another, on the point at least. On said point, that side facing the point end of the one winding of the spiral rib connects directly to the outer side, lying generally in parallel relationship with the geometrical drill axis, of a winding lying closer to the point end.

The soil-entering of said known displacement drill occurs relatively slowly and requires much power.

One reason for this is probably the fact that the soil particles can move in the upwards direction relative to the point exclusively by following the spiral rib, whereby they thus have to move along that side facing the point end of the spiral rib. It is clear that said soil particles have to cover thereby quite a long path for a limited upwards displacement relative to the point. With such known drills, the soil appears to be pressed-away mostly sidewise by the point. The blade-shaped portion of the spiral rib lying on the cylinder-shaped portion actually causes a displacement along a direction in parallel relationship with the geometrical axis of the drill, that is along a vertical direction, of the already sidewise-compacted soil particles, but horizontally-displaced soil particles often have to wait for a half to nearly one revolution before also being displaced along a vertical direction.

The invention has for object to provide a displacement drill which enters the soil more easily and faster than said known displacement drill.

THE INVENTION

For this purpose, the soil-displacement drill comprises at least two spiral ribs which are joined together at the most with the end thereof on the point end, but which for the remainder lie spaced away from one another over the whole length thereof, and the inner side of that portion lying on the point of each of said spiral ribs, makes on the lower side an angle to the point outer side which is smaller than 90° increased by half the apex angle of the point, and the upper side of that portion lying on the cylinder-shaped portion, of each of said spiral ribs connects to the outer side of that portion lying on the point, of the same spiral rib, adjacent to the lower part of said latter outer side.

It did appear surprisingly that due to the above-defined structural changes, the displacement drill enters the soil markedly faster, even up to twice as fast as the above known displacement drill.

In a particular embodiment of the invention, the soil-displacement drill comprises three such spiral ribs which are evenly distributed over the circumference of the point.

In a remarkable embodiment of the invention, the apex angle of the cone-shaped point lies between 85° and 95°.

With said known soil-displacement drill, the apex angle lies necessarily between 53° and 57°.

In a useful embodiment of the invention, the upper side of that portion lying on the cylinder-shaped portion, of each spiral rib, makes with the outer side of said cylinder-shaped portion, an angle which lies between 85° and 95°.

The soil-displacement drill may according to a particular embodiment of the invention, comprise two parts removable from one another, namely one part which comprises the drill pipe and a head which comprises the point with spiral rib portions thereon.

The cylinder-shaped portion can form a unit with the drill pipe, but is preferably part of the head, which head is then provided with the complete spiral ribs, and is hollow in such a way that the drill pipe may enter with the lowermost end thereof the cylinder-shaped portion.

Said head may be offered for sale as such.

In another remarkable embodiment of the invention, the soil-displacement drill comprises inwardly a line for the feeding of a hardenable liquid material, which line opens on the outside at that drill end where the point lies.

In a variation, said line opens through at least one opening on the outerside of the lowermost end of the drill pipe.

In another variation, said line opens through at least one opening on the point end.

The invention further pertains to a method for the manufacturing of a pile in the ground, whereby use is made of a soil-displacement drill provided with a line for hardenable material, and on the one hand a liquid hardenable material is pumped through the line, and on the other hand concrete is poured in the drilled opening, above the point which is left behind in the ground.

The hardenable material may be injected after the setting of the concrete which is poured in the drill pipe. Preferably, said hardenable material is however already fed at the end of the entering of the soil-displacement drill in the ground.

In all the cases, the hardenable material mixes with the soil around the lowermost portion of the soil-displacement drill, and it does increase the load capacity of the formed pile after setting. In that case where use is made of a soil-displacement drill wherein the line for the hardenable material opens adjacent to the point end, said material is mixed around the point with soil particles and forms after hardening, a reinforced foot for the concrete pile.

Other details and advantages of the invention will stand out from the following description of a soil-displacement drill and of a method for the manufacturing of a pile, according to the invention; this description is only given by way of example and does not limit the invention; the reference numerals pertain to the accompanying drawings.

DRAWINGS

In the various figures, the same reference numerals pertain to the same elements.

DESCRIPTION OF PREFERRED EMBODIMENTS

Figure 1:
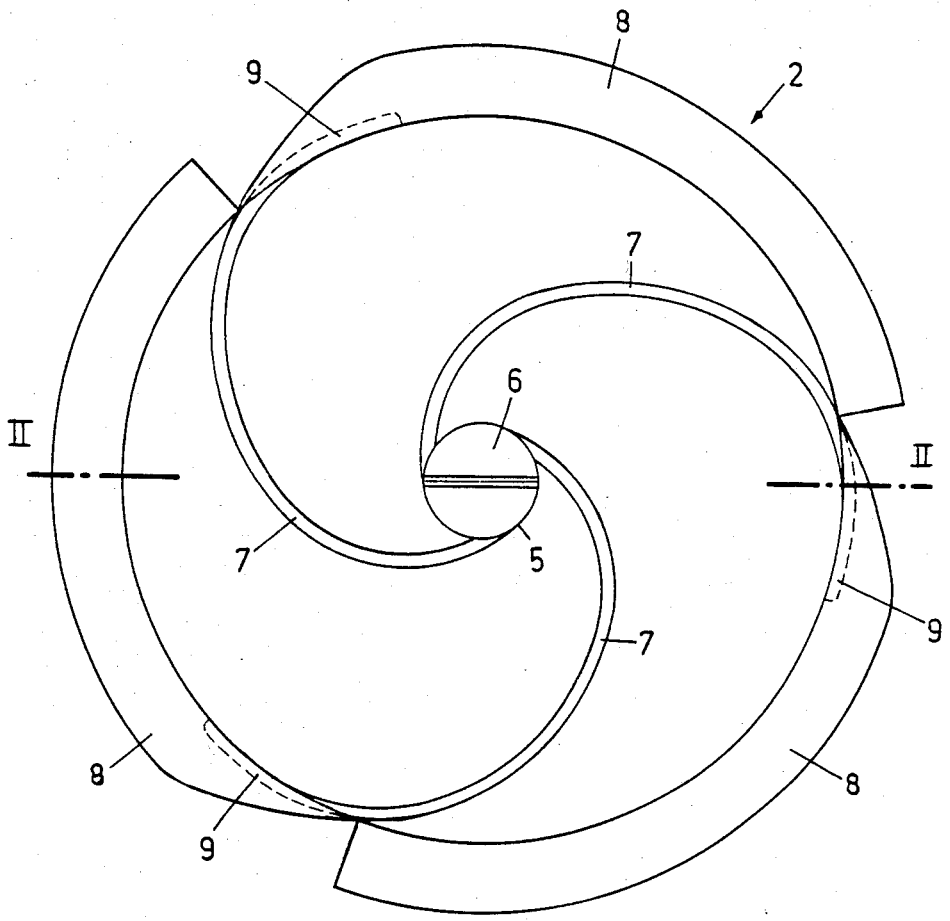
FIG. 1 is a bottom view of a soil-displacement drill according to the invention.
Figure 2:
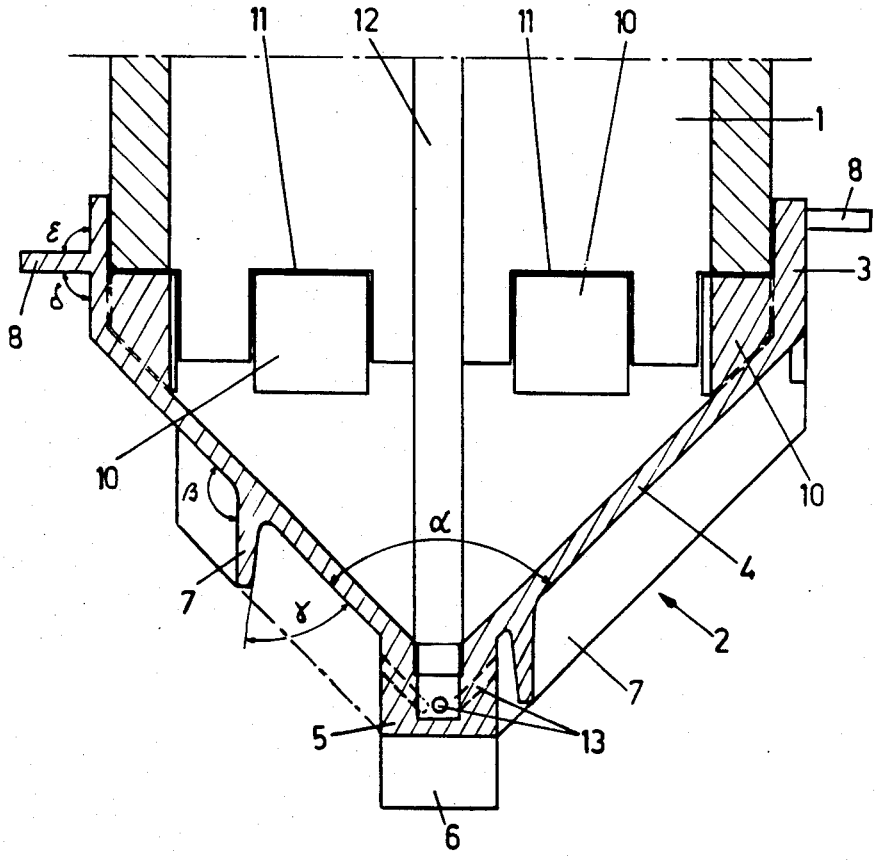
FIG. 2 is a cross-section along line II—II in FIG. 1.
Figure 3:
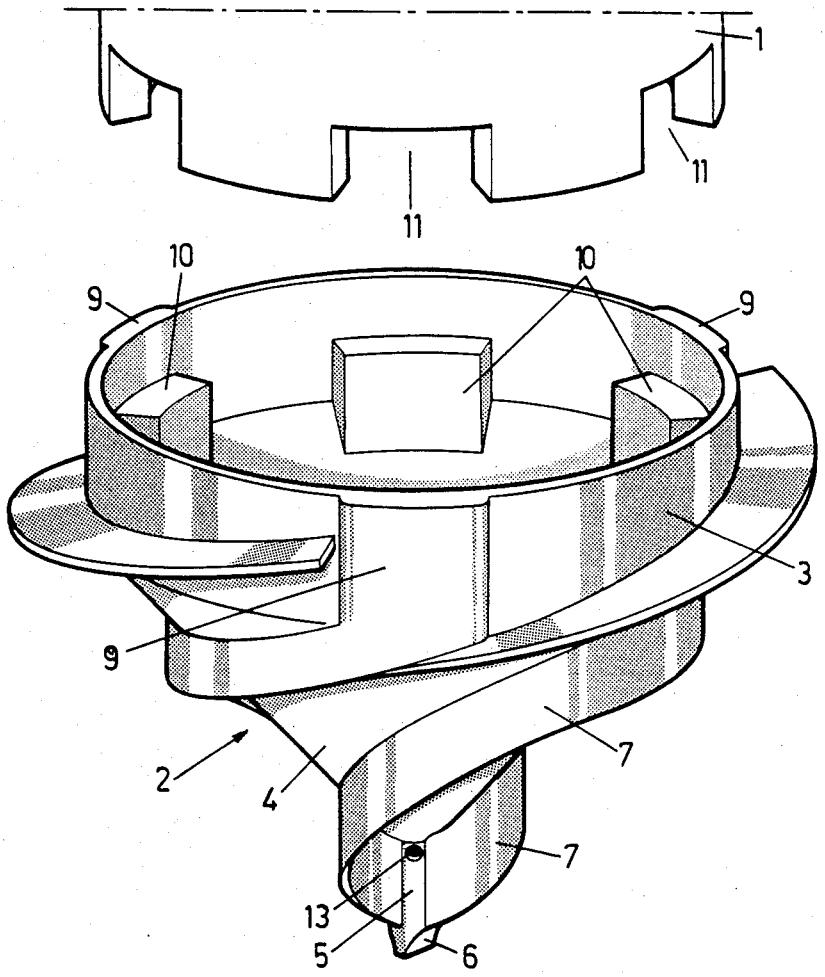
FIG. 3 is a perspective view of the soil-displacement drill from the preceding figures, but whereby the drill tube part of which only is shown, has been shown loose from the displacement head.
Figure 4:
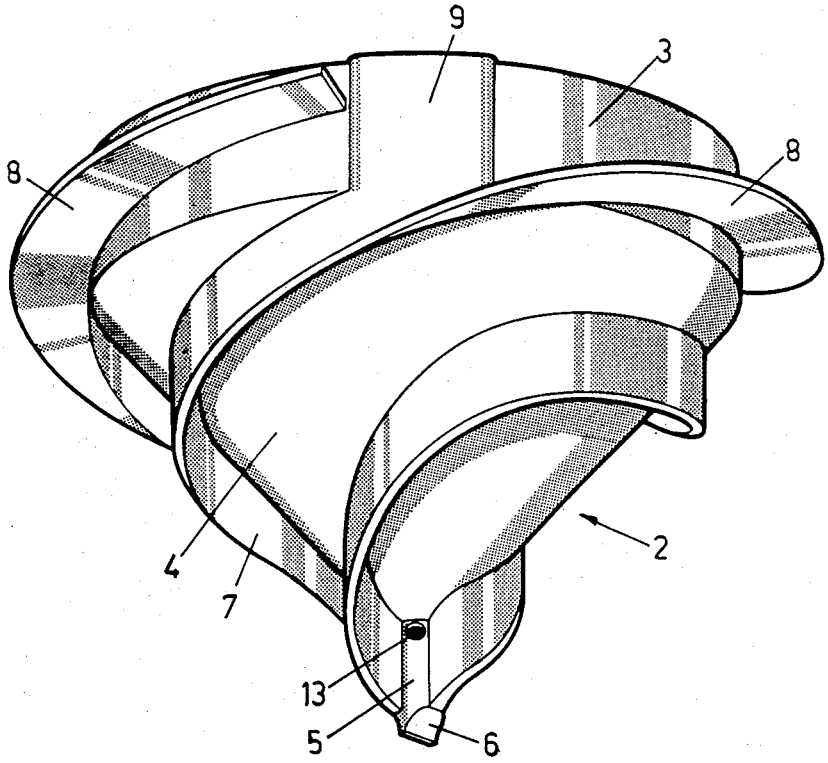
FIG. 4 is another perspective view of the soil-displacement head from FIG. 3.

The soil-displacement drill as shown in the FIGS. 1 to 3 is essentially comprised of a round steel drill pipe 1 and a hollow cast-iron head, generally indicated with the reference numeral 2.

The head 2 is formed by an uppermost cylinder-shaped portion 3, a cone-shaped point 4 connecting to said portion, a cylinder-shaped point portion 5 connecting to the point end of said point 4, with a tool bit 6 at the end thereof, and three spiral ribs 7,8.

The apex angle of point 4, shown with reference $\beta$ in FIG. 2, lies between 85° and 95°, and is preferably equal to 90° as shown in FIGS. 1 to 3.

Each spiral rib 7,8 is comprised of a portion 7 which stands on point 4, and a portion 8 connecting thereto which stands on the cylinder portion 3. Said ribs 7,8 are formed by a blade with a constant width, to the exception of that location where portion 7 thereof connects to portion 8 thereof. Spiral rib portion 7 has however another direction than portion 8.

That side removed from the point end, that is the outwardly-facing side, of portion 7 of each spiral rib 7,8 makes with the outer side of point 4 an outer angle which is at least equal to 175° less half the apex angle $\alpha$ of point 4. Said outer angle is shown with reference $\beta$ in FIG. 2. This means that the outer side of portion 7 may not move far away downwards from the geometrical axis of the displacement drill, but has to extend towards said axis, or run substantially parallel thereto. The soil-entering of the head and sidewise compacting of the soil particles by the head is thereby made easier. The outer side of portion 7 can however not extend downwards too strongly towards the geometrical axis, and said angle $\beta$ preferably lies between $(175°-\alpha/2)$ and $(185°-\alpha/2)$, or even is substantially equal to $180°-\alpha/2$ as shown in FIGS. 1 to 3.

The other side of portion 7, that is thus the point-facing inner side, has to make on the point end-facing side, an angle $\gamma$ with the outer side of point 4 which is smaller than 90° increased by half the apex angle $\alpha$ of the point, to make the removal upwards of the soil particles easier. This thus means that with a vertical position of the drill geometrical axis, that is thus the normal position when boring ground, the inner side should extend more or less downwards from point 4. Said side may thereby be substantially parallel to the drill geometrical axis, and preferably makes an angle $\gamma$ with the outer side of point 4, which lies between half the apex angle $\alpha$ and said half increased by 10° , as shown in FIGS. 1 to 3.

Actually this means that portion 7 of each spiral rib 7,8 is a blade which is directed in parallel relationship with the geometrical axis of point 4 and thus of the complete drill, but the thickness of which increases somewhat towards point 4. This latter feature is desirable for casting technique reasons, and allows to use less material for the blade without danger of said blade breaking away from point 4.

The portions 7 of the three spiral ribs 7,8 connect at the point end with the ends thereof to the cylinder-shaped point portion 5, above the tool bit 6. As considered from the point end, the three portions 7 extend in fan shape, regularly distributed over the outer side of point 4 as it appears clearly from FIG. 1. The portions 7 each describe thereby less than half a revolution about the geometrical axis of point 4 between the cylinder-shaped point portion 5 and the cylinder-shaped portion 3 of head 2. The adjacent portions 7 lie over the whole length thereof with a relatively wide spacing from one another, which spacing increases very rapidly from point portion 5 towards the cylinder-shaped portion 3.

On the side of cylinder-shaped portion 3, the outer side of each portion 7 merges smoothly with the outer side of a projection 9 on the outer side of the cylinder-shaped portion 3.

Those portions 8 standing on said cylinder-shaped portion 3, of the spiral ribs, are blades with a constant width, as measured along a radial direction relative to portion 3, to the exception of the location of the connection to a portion 7.

Each portion 8 extends along a spiral line or helical line with small pitch over somewhat more than one fourth of a revolution about the axis of head 2. That side facing the point end of each portion 8, that is thus the lower side, makes at the bottom side an angle $\delta$ with the outer side of portion 3, of 95° at the most and preferably about 90° as shown in FIGS. 1 to 4. The upper side of each portion 8 makes with the outer side of portion 3, an angle $\epsilon$ lying between 85° and 95° and which is preferably substantially equal to 90° . The blade-forming portions 8 then also have over the whole width thereof, a substantially constant thickness. When the soil-displacement drill bores vertically in the ground, said portions 8 extend consequently horizontally along the radial direction relative to portion 3. As said portion 3 has a relatively low height, the slanting of each portion 8 as considered along the lengthwise direction of the helical rib, is relatively small.

The portion 8 connects with one end to portion 7 of the corresponding spiral rib 7,8, and more particularly to the bottom of the outer side of the uppermost end, merging into said projection 9, of said portion 7. The outermost edge of portion 8 merges thereby smoothly with the lowermost edge of the corresponding portion 7. In the transition location, the width of portion 8 increases along that direction away from portion 7, from zero up to the normal width thereof, which is moreover equal to the width of portion 7.

The inner diameter of cylinder-shaped portion 3 is somewhat larger than the outer diameter of the drilling pipe 1. On the inner side of portion 3 lie six driving projections 10. The lowermost end of the drilling pipe 1 is provided with corresponding recesses 11, so that the drilling pipe 1 can be brought with the lowermost end thereof, drivingly through the drive projections 10, into the cylinder-shaped portion 3.

The drilling pipe 1 is removably coupled in this way to head 2.

The displacement drill finally also comprises a tube 12 which is screwed with a narrowed end provided outwardly with a screw-thread, into the hollow point portion 5 of cylinder shape and provided inwardly with a screwthread. For clearness' sake, said tube 12 has been shown neither in FIG. 3, nor in FIG. 4 which only shows head 2.

Three openings 13 extend through the wall of said hollow portion 5. Said openings 13 open on the inner side of the hollow point portion 5, below the end of tube 12, when said tube is fully screwed down in point portion 5. They extend slantingly upwards at an angle which is equal to half the apex angle $\alpha$ of point 4, and they open directly below point 4, between the portions 7 of spiral ribs 7,8, on the outer side. Through tube 12 and openings 13, it is possible to inject between the adjacent spiral ribs 7,8, a liquid hardenable cement-base mixture.

For manufacturing a pile in the ground with the above-described soil-displacement drill, one proceeds as follows.

The drilling pipe 1 is so located on head 2 as to have the drive projections 10 lie in the recesses 11. By rotating drilling pipe 1 and exerting a downwards pressure thereon, the displacement drill is driven in the ground, generally vertically.

The soil particles are displaced sidewise and thus horizontally by said portions 7 of the three spiral ribs 7,8. Said particles can however also move over head 2 in the upwards direction. This is certainly the case when due to horizontal displacement, the soil around head 2 is already so compacted that no further compacting is possible along the horizontal direction. Said soil particles moving in the upwards direction over the rotating head 2, move very fast from the outer side of portion 7 of a spiral rib 7,8, to the upper side of portion 8 of the same spiral rib 7,8, and said particles are then displaced by said portion 8 along the vertical direction. Said soil particles finally reach a location where the ground offers the least counter-pressure, that is at the location of soft spots in the ground. As portions 8 of the three spiral ribs 7,8 have a small slanting, they do exert on the soil particles a high displacement force.

After the soil-displacement drill has reached the required depth, the drilling pipe 1 is removed. The tube 12 is arranged when this was not done before, and concrete is poured round the tube 12 in the formed opening. The head 2 remains in position in the ground.

After hardening of the concrete, a liquid hardenable cement-base material is pumped under pressure through tube 12. Said material squirts through openings 13 out of the head 2 and mixes with the soil about said head. Said material hardens together with the soil and increases the load capacity of the formed pile, and increases the setting attitude thereof.

It is possible to already start pumping the hardenable liquid material during the boring in the ground with the displacement drill. That material which is pressed outwards through openings 13, is carried along by the spiral ribs 7,8 and mixed with the soil. There is formed about the displacement drill, a lining of soil mixed with said material. After hardening of said material, said lining insures a higher load capacity for the pile.

It is generally to be preferred to leave the drilling pipe 1 in the ground as a shaft for the pile to be formed.

In such a case, it is of course not necessary to have the drilling pipe 1 removable from the head 2. The drilling pipe 1 may be welded to head 2 as in the embodiments of the soil-displacement drill shown in FIGS. 5 to 7.

Figure 5:
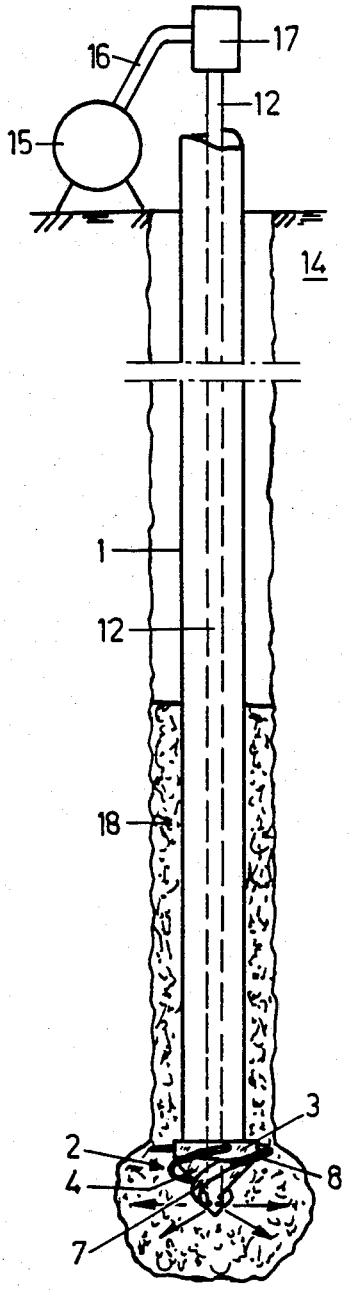
FIG. 5 is a diagrammatic showing of a soil-displacement drill according to the invention during the working of the method according to the invention, and pertaining to another embodiment of the soil-displacement drill than the one shown in FIGS. 1 to 3.
Figure 6:
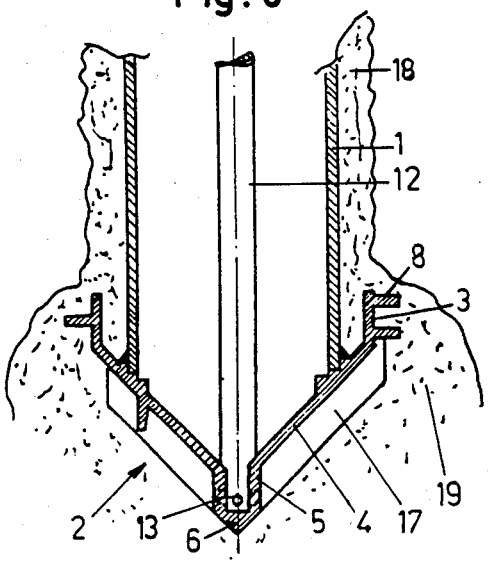
FIG. 6 shows a vertical cross-section through the lowermost end of the soil-displacement drill shown in FIG. 5, on a larger scale.

The embodiment of the soil-displacement drill shown in FIGS. 5 and 6 differs from the above-described embodiment in the drilling pipe 1 being welded as already stated, with the lower end thereof to the inner side of head 2 and actually of point 4. The outer diameter of drilling pipe 1 is in this case markedly smaller than the inner diameter of the cylinder-shaped portion 3.

The soil-displacement drill is driven in the above-described way in the ground 14. Over the last five to six meters, a liquid hardenable material is pumped in the tube 12, by means of the pump 15, through line 16 and seal 17. The seal 17 insures the connection between the stationary line 16 and the tube 12 rotating together with drilling pipe 1 and head 2. As one bores deeper in ground 14, there is formed about the drilling pipe 1, a lining 18 which is formed by a mixture of soil and hardenable material. When the soil-displacement drill is deep enough in the ground, an additional amount of said hardenable material is further pumped, in such a way that a reinforced foot 19 is formed about head 2, by a mixture of soil and hardenable material.

Figure 7:
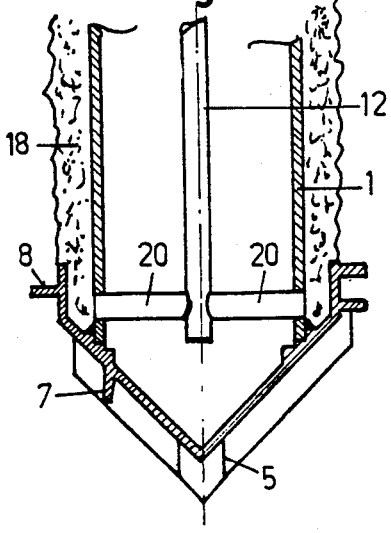
FIG. 7 shows a vertical cross-section similar to the one from FIG. 6, but pertaining to still another embodiment of the soil-displacement drill according to the invention.

The embodiment of the soil-displacement drill as shown in FIG. 7 differs from the embodiment as shown in FIGS. 5 and 6, due to the lowermost end of tube 12 not opening through openings 13 below point 4, but rather opening through radial channels 20 on the outer side of the lowermost end of the drilling pipe 1, at the level of cylinder-shaped portion 3.

The method for forming a pile is completely similar to what has been described in relation with FIGS. 5 and 6. Naturally no reinforced foot 19 is formed here about head 2, but simply a lining 18 about drilling pipe 1.

The invention is in no way limited to the above-described embodiments and within the scope of the invention, many changes may be brought to the described embodiments, notably as regards the shape, the composition, the arrangement and the number of the components which are being used to embody the invention.

The head does not have necessarily to comprise three spiral ribs. It is enough for said head to comprise two such ribs.

In the embodiments of the drill whereby the head is removable from the drilling pipe, the cylinder-shaped portion does not have necessarily to be part of the head.

Said cylinder-shaped portion with the spiral rib portions standing thereon, may be integral with the drilling pipe.

The soil-displacement drill does not either have to comprise necessarily a tube for pumping a liquid hardenable material.

The spiral ribs do not have necessarily either to be plates and do not even have to be solid. Particularly those portions standing on the point may for example be comprised of a blade and a plate which partly closes the space on the bottom between said plate and the point. Said plate then forms the above-mentioned inner side of said portions.

Said inner side of that portion standing on the point of the spiral ribs does not have necessarily to be directed substantially parallel to the boring axis. It is of importance that said side is extending away from the point, thus outwards at least somewhat downwards. When said side is extending downwards and surely when it is for instance substantially parallel to the drill axis as shown in the figures, there appears during the driving of the head in the ground, that soil is present between said lower side and the point, which soil seems to make the sidewise movement of the soil particles easier.

In the embodiment of the drilling pipe whereby the cylinder-shaped portion is part of a head which is removable from the drilling pipe, said cylinder-shaped portion at least should be hollow, as said portion is provided on the outer side with a portion of the spiral ribs and the drilling pipe thus has to enter the head, but with the other embodiment, said portion does not necessarily have to be hollow and the head may be solid.

I claim:

1. A soil-displacement drill comprising:

a drill pipe having a lower end;

a head having an upwardly extending cylindrically-shaped portion and a downwardly directed conically-shaped portion having an apex, said head being mounted on the lower end of said drill pipe;

at least two equally spaced spiral ribs appending from said head, each spiral rib defining a substantially vertical section extending from the apex of said conically-shaped portion to said cylindrically-shaped portion and a substantially horizontally extending radial section extending around a portion of said cylindrically-shaped portion as an extension of said substantially vertical section.

2. The soil-displacement drill of claim 1 wherein said ribs are thrice in number equally spaced on said head.

3. The soil-displacement drill of claim 1 wherein the apex of said conically shaped portion has an apex angle of between 85° to 95°.

4. The soil-displacement drill of claim 1 wherein said substantially vertical rib section has a lower edge and said substantially horizontally extending radial section has an outer edge, said lower edge of said substantially vertical rib section merging into the outer edge of said substantially horizontally extending radial section.

5. The soil-displacement drill of claim 1 wherein said substantially vertical rib section has an outer side and the apex of said conically-shaped portion has an apex angle, the outer side of said rib making an angle with the conically-shaped portion of at least 175° less half the apex angle.

6. The soil-displacement drill of claim 5 wherein said angle is between 175° less half the apex angle and 185° less half the apex sngle.

7. The soil-displacement drill of claim 6 wherein said substantially vertical rib section has a lower edge and said substantially horizontally extending radial section has an outer edge, said lower edge of said substantially vertical rib section merging into the outer edge of said substantially horizontally extending radial section.

8. The soil-displacement drill of claim 1 wherein said substantially vertical rib section has an inner side and the apex of said conically-shaped portion has an apex angle, the inner side of said rib making an angle with the conically-shaped portion of smaller than 10° increased by half the apex angle.

9. The soil-displacement drill of claim 1 including a cylindrically shaped terminus to the conically-shaped portion at the apex, said spiral ribs being fixed to said terminus.

10. The soil-displacement drill of claim 9 including a tool bit on the terminus.

11. The soil-displacement drill of claim 1 wherein said substantially horizontally extending radial section has a lower side, said lower side making an angle with a side of said cylindrically-shaped portion of at most 95°.

12. The soil-displacement drill of claim 1 wherein said substantially horizontally extending radial section has an upper side, said upper side making an angle with a side of said cylindrically-shaped portion of between 85° and 95°.

13. The soil-displacement drill of claim 1 wherein the head is removably mounted on the lower end of the drill pipe.

14. The soil-displacement drill of claim 1 including a hardenable liquid material feed line and wherein said head defines an opening therein, said line being positioned within the drill pipe and in communication with the outside of the drill through the opening in the head.

15. The soil-displacement drill of claim 1 including a hardenable liquid material feed line positioned within said drill pipe and wherein the lower end of said drill pipe has transverse openings therein, said feed line being in communication with said openings to communicate with the outside of the lower end of the drill pipe.

16. The soil-displacement drill of claim 15 wherein said head is hollow, said drill pipe being connected to the interior of said conically-shaped portion to define an annular space between the outside of the lower end of the drill pipe and the interior of the cylindrically-shaped portion, said feed line being in communication with said annular space.

17. The soil-displacement drill of claim 14 wherein the apex of said conically-shaped portion defines an opening therein communicating with the outside of said head, said feed line being in communication with said opening.

* * * * *